US009347326B2

(12) United States Patent
Kim et al.

(10) Patent No.: US 9,347,326 B2
(45) Date of Patent: May 24, 2016

(54) INTEGRAL COVER BUCKET ASSEMBLY

(71) Applicant: General Electric Company, Schenedtady, NY (US)

(72) Inventors: Tai Joung Kim, Glenville, NY (US); Timothy Scott McMurray, Fultonville, NY (US); John Thomas Basirico, Albany, NY (US)

(73) Assignee: General Electric Company, Schenectady, NY (US)

( * ) Notice: Subject to any disclaimer, the term of this patent is extended or adjusted under 35 U.S.C. 154(b) by 740 days.

(21) Appl. No.: 13/667,930

(22) Filed: Nov. 2, 2012

(65) Prior Publication Data

US 2014/0127020 A1 May 8, 2014

(51) Int. Cl.
*F01D 5/22* (2006.01)
*F01D 5/30* (2006.01)

(52) U.S. Cl.
CPC *F01D 5/22* (2013.01); *F01D 5/303* (2013.01); *F05D 2220/31* (2013.01); *Y10T 29/49321* (2015.01)

(58) Field of Classification Search
CPC ..... F01D 5/22; F01D 5/225; F01D 5/303; F01D 5/303; F01D 5/30; F01D 25/04; F01D 25/06; F05D 2220/31; F05D 2260/96; Y10T 29/49321
USPC ..... 416/190, 191, 220, 220 R, 215–217; 29/889.21
See application file for complete search history.

(56) References Cited

U.S. PATENT DOCUMENTS

| | | | |
|---|---|---|---|
| 3,572,968 | A | 3/1971 | Musick et al. |
| 4,602,412 | A | 7/1986 | Partington et al. |
| 4,710,102 | A | 12/1987 | Ortolano |
| 4,765,046 | A | 8/1988 | Partington et al. |
| 5,211,540 | A | 5/1993 | Evans |
| 5,238,368 | A | 8/1993 | Ortolano |
| 5,509,784 | A | 4/1996 | Caruso et al. |
| 6,036,437 | A | 3/2000 | Wolfe et al. |
| 6,644,924 | B1 | 11/2003 | Frolov et al. |
| 6,827,554 | B2 | 12/2004 | Caruso et al. |
| 6,846,160 | B2 | 1/2005 | Saito et al. |
| 7,097,428 | B2 | 8/2006 | Barb et al. |
| 7,182,577 | B2 * | 2/2007 | Yamashita et al. ..... 416/191 |
| 7,270,518 | B2 | 9/2007 | Barb et al. |
| 2003/0012655 | A1 | 1/2003 | Sasaki et al. |
| 2011/0008173 | A1 | 1/2011 | Tsukuda et al. |

FOREIGN PATENT DOCUMENTS

| | | | |
|---|---|---|---|
| CN | 1529788 | A | 9/2004 |
| DE | 102008051935 | A1 | 4/2010 |
| FR | 2950104 | A1 | 3/2011 |
| JP | 2004028094 | A | 1/2004 |
| WO | 2010040339 | A1 | 4/2010 |

OTHER PUBLICATIONS

Unofficial English translation of Chinese Office Action issued in connection with corresponding CN Application No. 201310534077.2 on Dec. 30, 2015.

* cited by examiner

*Primary Examiner* — Richard Edgar
*Assistant Examiner* — Brian P Wolcott
(74) *Attorney, Agent, or Firm* — Armstrong Teasdale LLP

(57) ABSTRACT

A bucket assembly includes a plurality of first buckets, and a pair of transition buckets. Each first bucket includes a bucket cover including a pair of lateral edges each having a first configuration. Each transition bucket includes a transition cover including a first lateral edge having the first configuration and a second lateral edge having a second configuration.

20 Claims, 4 Drawing Sheets

INTEGRAL COVER BUCKET ASSEMBLY

BACKGROUND

The present disclosure relates generally to turbine engines and, more particularly, to a bucket assembly for use in a turbine engine.

At least some known turbine engines include a rotor assembly including a rotor disk and a bucket assembly coupled to the rotor disk. Some known bucket assemblies include buckets including a cover, an airfoil, and a dovetail. Although known dovetails facilitate coupling the buckets to the rotor disk, the coupling process may be tedious and/or time consuming. For example, the cover of one bucket may interfere with the dovetail and/or the airfoil of a circumferentially-adjacent bucket during assembly. To position such buckets next to a circumferentially-adjacent bucket that was previously installed, at least a portion of the bucket may be removed and/or trimmed such that the cover no longer interferes with the dovetail and/or the airfoil of the adjacent bucket. However, removing and/or trimming a portion of the bucket may decrease a performance of the turbine engine.

BRIEF SUMMARY

In one aspect, a method is provided for use in assembling a bucket assembly. The method includes coupling a first bucket and a second bucket to a rotor disk. The first and second buckets each include a bucket cover that includes a pair of lateral edges that are each formed in a first configuration. A first transition bucket is coupled to the rotor disk and against the first bucket. The first transition bucket includes a first transition cover that includes a first lateral edge formed in the first configuration and a second lateral edge formed in a second configuration. A second transition bucket is coupled to the second bucket. The second transition bucket includes a second transition cover that includes a first lateral edge formed in the first configuration and a second lateral edge formed in the second configuration.

In another aspect, a bucket assembly is provided for use with a turbine engine. The bucket assembly includes a plurality of first buckets, and a pair of transition buckets. Each first bucket includes a bucket cover including a pair of lateral edges each formed in a first configuration. Each transition bucket includes a transition cover including a first lateral edge formed in the first configuration and a second lateral edge formed in a second configuration.

In yet another aspect, a turbine engine is provided. The turbine engine includes a rotor disk, and a bucket assembly coupled to the rotor disk. The bucket assembly includes a plurality of buckets, and a pair of transition buckets. Each bucket of the plurality of buckets includes a bucket cover including a pair of lateral edges each formed in a first configuration. Each transition bucket of the pair of transition buckets includes a transition cover including a first lateral edge formed in the first configuration and a second lateral edge formed in a second configuration.

The features, functions, and advantages described herein may be achieved independently in various embodiments described in the present disclosure or may be combined in yet other embodiments, further details of which may be seen with reference to the following description and drawings.

Although specific features of various embodiments may be shown in some drawings and not in others, this is for convenience only. Any feature of any drawing may be referenced and/or claimed in combination with any feature of any other drawing.

DETAILED DESCRIPTION

The present disclosure relates generally to turbine engines and, more particularly, to bucket assemblies for use in a turbine engine. In some embodiments, the bucket assembly includes a plurality of integral covered (IC) buckets. As used herein, the term "integral" refers to a bucket that includes a cover. The bucket may be integrally formed with the cover (e.g., via machining from bar stock material, wherein the vane and cover are machined from the same piece of bar stock, or casting) or, alternatively, the cover may be integrally coupled to the airfoil (e.g., via welding). In one embodiment, the plurality of IC buckets include a plurality of first buckets, and at least a pair of transition buckets. Each first bucket includes a bucket cover including a pair of lateral edges each formed in a first configuration. Each transition bucket includes a transition cover including a first lateral edge formed with the first configuration and a second lateral edge formed in a second configuration. As such, the bucket assembly may be assembled without requiring modification of or removal of a portion of any of the buckets.

As used herein, an element or step recited in the singular and preceded with the word "a" or "an" should be understood as not excluding plural elements or steps unless such exclusion is explicitly recited. Moreover, references to "one embodiment" are not intended to be interpreted as excluding the existence of additional embodiments that also incorporate the recited features.

Figure 1:
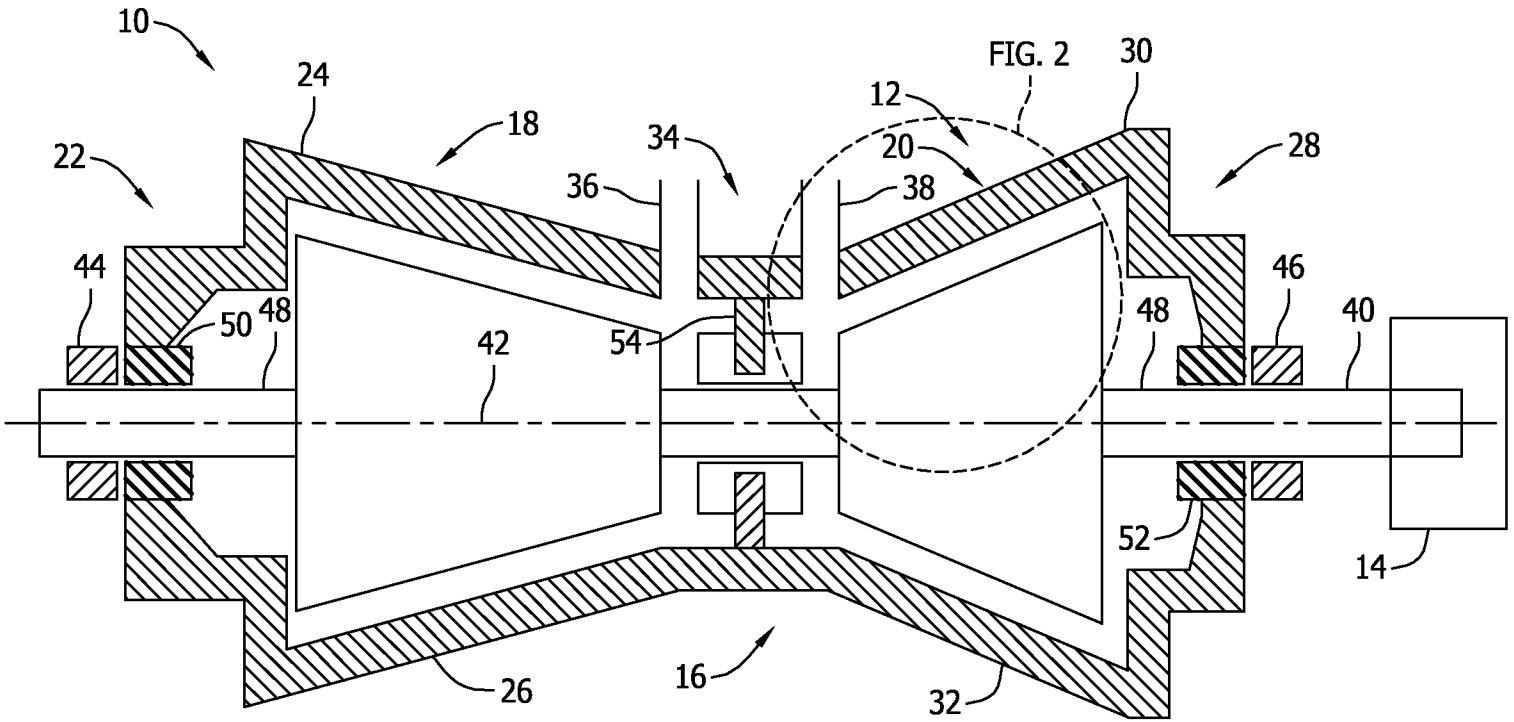
FIG. 1 is a schematic illustration of an exemplary turbine engine.

FIG. 1 is a schematic illustration of an exemplary turbine engine 10. In some embodiments, turbine engine 10 is an opposed-flow, high-pressure (HP) and intermediate-pressure (IP) steam turbine assembly. In other embodiments, turbine engine 10 may be any type of steam turbine, such as, without limitation, a low-pressure turbine, a single-flow steam turbine, and/or a double-flow steam turbine.

In some embodiments, turbine engine 10 includes a turbine 12 that is coupled to a generator 14 via a rotor assembly 16. In some embodiments, turbine 12 includes a HP section 18 and an IP section 20. An HP casing 22 is divided axially into upper and lower half sections 24 and 26, respectively. Similarly, an IP casing 28 is divided axially into upper and lower half sections 30 and 32, respectively. A central section 34 extends between HP section 18 and IP section 20, and includes an HP steam inlet 36 and an IP steam inlet 38.

Rotor assembly 16 extends between HP section 18 and IP section 20 and includes a rotor shaft 40 that extends along a centerline axis 42 between HP section 18 and IP section 20. Rotor shaft 40 is supported from casing 22 and 28 by journal bearings 44 and 46, respectively, that are each coupled to opposite end portions 48 of rotor shaft 40. Steam seal units 50 and 52 are coupled between rotor shaft end portions 48 and casings 22 and 28 to facilitate sealing HP section 18 and IP section 20.

An annular divider 54 extends radially inwardly between HP section 18 and IP section 20 from central section 34 towards rotor assembly 16. More specifically, divider 54 extends circumferentially about rotor assembly 16 between HP steam inlet 36 and IP steam inlet 38.

During operation, steam is channeled to turbine 12 from a steam source, for example, a power boiler (not shown), wherein steam thermal energy is converted to mechanical rotational energy by turbine 12, and subsequently electrical energy by generator 14. More specifically, steam is channeled through HP section 18 from HP steam inlet 36 to impact rotor assembly 16 positioned within HP section 18 and to induce rotation of rotor assembly 16 about axis 42. Steam exits HP section 18 and is channeled to a boiler (not shown) that increases a temperature of the steam to a temperature that is approximately equal to a temperature of steam entering HP section 18. Steam is then channeled to IP steam inlet 38 and to IP section 20 at a reduced pressure than a pressure of the steam entering HP section 18. The steam impacts the rotor assembly 16 that is positioned within IP section 20 to induce rotation of rotor assembly 16.

Figure 2:
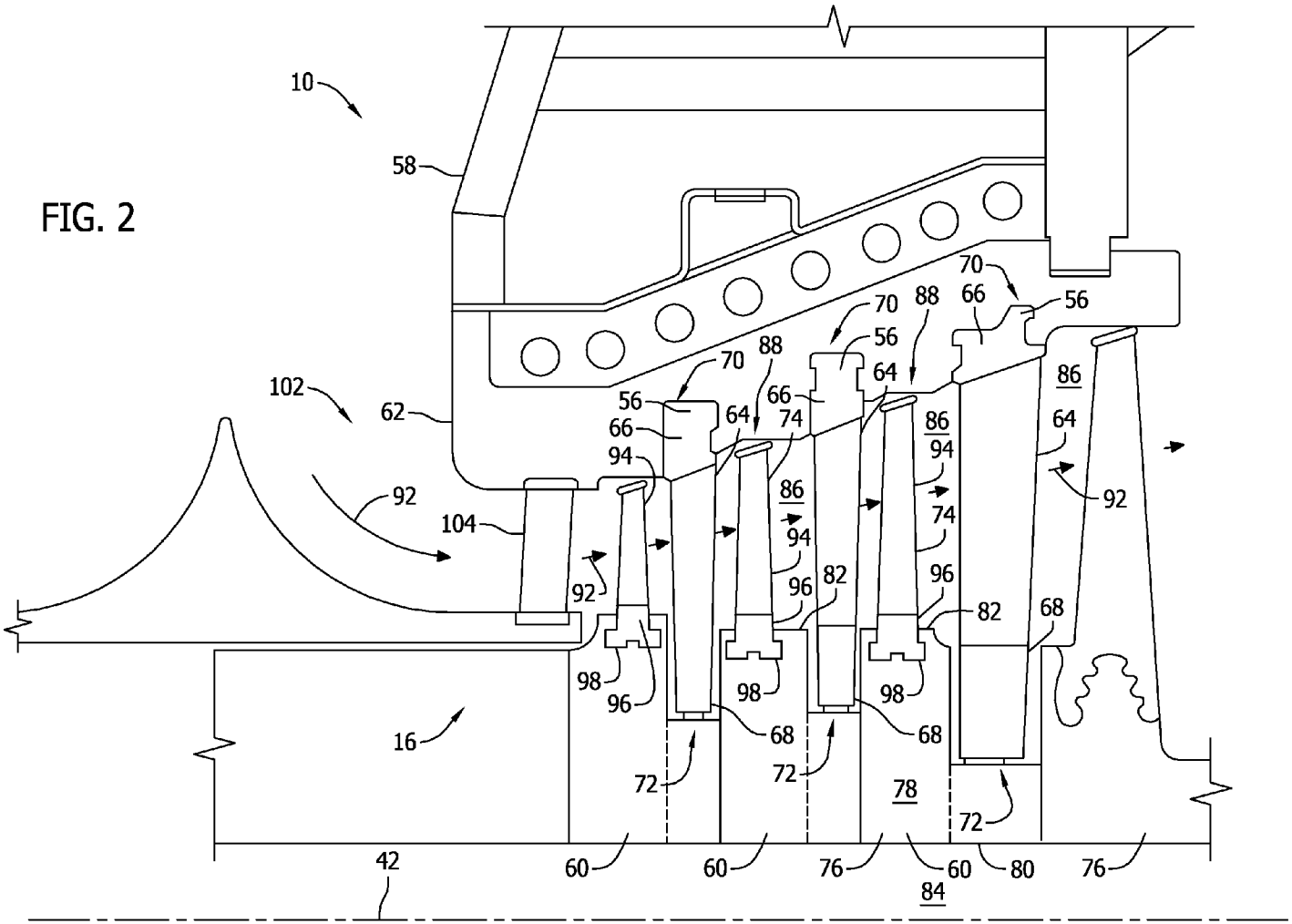
FIG. 2 is an enlarged schematic illustration of a portion of the turbine engine shown in FIG. 1 and taken along area 2.

FIG. 2 is an enlarged schematic illustration of a portion of turbine engine 10 taken along area 2. In some embodiments, turbine engine 10 includes rotor assembly 16, a plurality of stationary diaphragm assemblies 56, and a casing 58 that extends circumferentially about rotor assembly 16 and diaphragm assemblies 56. Rotor assembly 16 includes a plurality of rotor disk assemblies 60 that are each aligned substantially axially between each adjacent pair of diaphragm assemblies 56. Each diaphragm assembly 56 is coupled to casing 58, and casing 58 includes a nozzle carrier 62 that extends radially inwardly from casing 58 towards rotor assembly 16. Each diaphragm assembly 56 is coupled to nozzle carrier 62 to facilitate preventing diaphragm assembly 56 from rotating with respect to rotor assembly 16. Each diaphragm assembly 56 includes a plurality of circumferentially-spaced nozzles 64 that extend from a radially outer portion 66 to a radially inner portion 68. Nozzle outer portion 66 is positioned within a recessed portion 70 defined within nozzle carrier 62 to enable diaphragm assembly 56 to couple to nozzle carrier 62. Nozzle inner portion 68 is positioned adjacent to rotor disk assembly 60. In one embodiment, inner portion 68 includes a plurality of sealing assemblies 72 that form a tortuous sealing path between diaphragm assembly 56 and rotor disk assembly 60.

In some embodiments, each rotor disk assembly 60 includes a plurality of turbine buckets 74 that are each coupled to a rotor disk 76. Rotor disk 76 includes a disk body 78 that extends between a radially inner portion 80 and a radially outer portion 82. Radially inner portion 80 defines a central bore 84 that extends generally axially through rotor disk 76. Disk body 78 extends radially outwardly from central bore 84.

Each turbine bucket 74 is coupled to rotor disk outer portion 82 such that buckets 74 are circumferentially-spaced about rotor disk 76. Each turbine bucket 74 extends radially outwardly from rotor disk 76 towards casing 58. Adjacent rotor disks 76 are coupled together such that a gap 86 is defined between each axially-adjacent row 88 of circumferentially-spaced turbine buckets 74. Nozzles 64 are spaced circumferentially about each rotor disk 76 and between adjacent rows 88 of turbine buckets 74 to channel steam downstream towards turbine buckets 74. A steam flow path 92 is defined between turbine casing 58 and each rotor disk 76.

In some embodiments, each turbine bucket 74 is coupled to an outer portion 82 of a respective rotor disk 76 such that each turbine bucket 74 extends into steam flow path 92. More specifically, each turbine bucket 74 includes a vane or airfoil 94 that extends radially outwardly from a dovetail 96. Each dovetail 96 is inserted into a dovetail groove 98 defined within an outer portion 82 of rotor disk 76 to enable turbine bucket 74 to be coupled to rotor disk 76.

During operation of turbine engine 10, steam is channeled into turbine 12 through a steam inlet 102 and into steam flow path 92. Each inlet nozzle 104 and diaphragm assemblies 56 channel the steam towards turbine buckets 74. As steam impacts each turbine bucket 74, turbine bucket 74 and rotor disk 76 are rotated circumferentially about axis 42.

Figure 3:
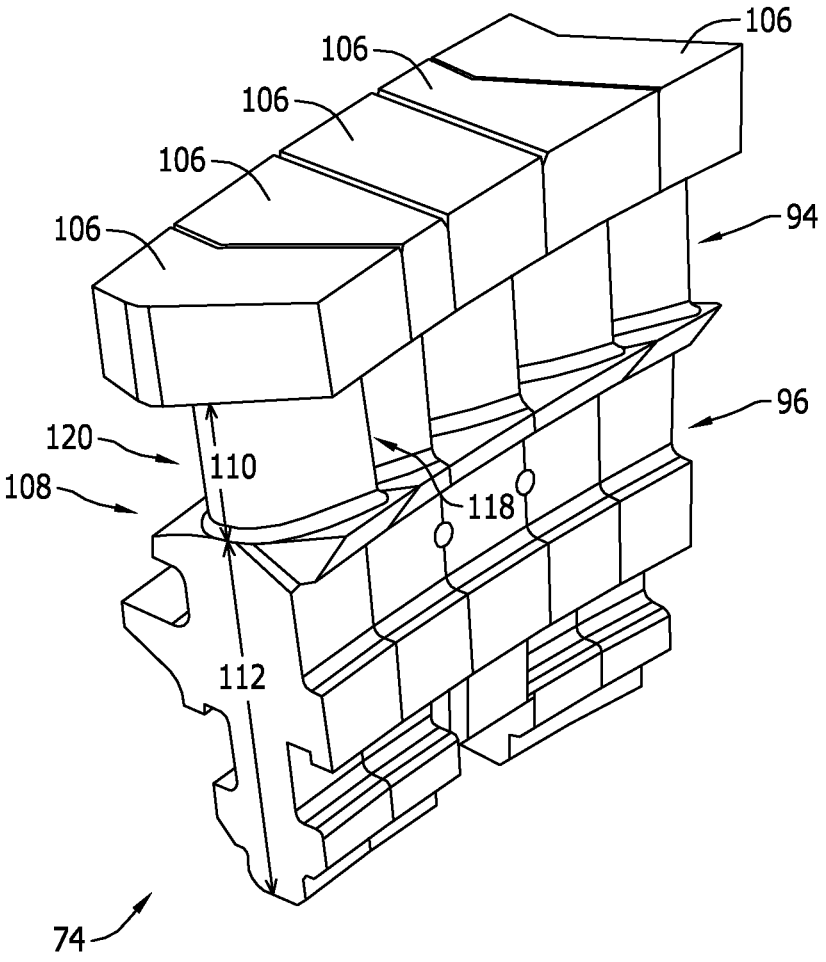
FIG. 3 is a perspective view of an exemplary bucket assembly used with the turbine engine shown in FIG. 1.
Figure 4:
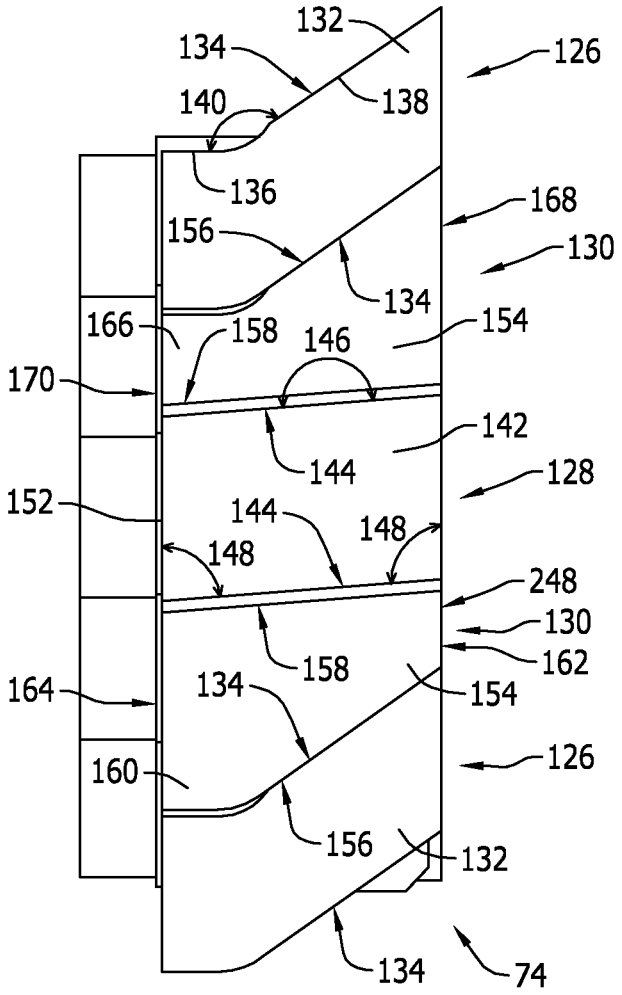
FIG. 4 is a top view of the bucket assembly shown in FIG. 3.

FIG. 3 is a perspective view of buckets 74. FIG. 4 is a top view of buckets 74. In some embodiments, each bucket 74 includes a cover 106 and a body 108 that extends radially inwardly from cover 106. In some embodiments, bodies 108 have the same and/or a substantially similar configuration. Body 108 includes airfoil 94 and dovetail 96. In some embodiments, an airfoil height 110 is shorter than a dovetail height 112. Alternatively, in other embodiments, airfoil 94 and/or dovetail 96 may have any height that enables bucket 74 to function as described herein. Airfoil 94 includes a leading edge 118 and an opposite trailing edge 120. More specifically, airfoil trailing edge 120 is spaced chord-wise and downstream from airfoil leading edge 118.

In some embodiments, buckets 74 include a plurality of buckets 126, a closure bucket 128, and at least a pair of transition buckets 130. In some embodiments, each cover 106 for each bucket 126 is a bucket cover 132 that includes a pair of lateral edges 134 that each has a first configuration. For example, in some embodiments, lateral edges 134 are substantially parallel to each other. In the exemplary embodiment, each lateral edge 134 includes a first segment 136 and a second segment 138 that extends obliquely from first segment 136 at an angle 140 such that the first configuration is an angled configuration. In the exemplary embodiment, angle 140 is between approximately 95° and approximately 175°. More specifically, in the exemplary embodiment, angle 140 is between approximately 120° and approximately 150°. Alternatively, in other embodiments, lateral edges 134 may have any configuration that enables bucket cover 132 to function as described herein.

In some embodiments, each cover 106 for closure bucket 128 is a closure cover 142 that includes a pair of lateral edges 144 that each has a second configuration. For example, in some embodiments, lateral edges 144 are substantially parallel to each other. In the exemplary embodiment, each lateral edge 144 defines or has an angle 146 that is greater than angle 140 and that is less than or equal to approximately 180°. More specifically, in the exemplary embodiment, angle 146 is approximately 180° such that lateral edge 144 is a substantially straight configuration.

Moreover, in some embodiments, each angle 148 defined between a lateral edge 144 and either a leading edge 150 or a trailing edge 152 is between approximately 60° and approximately 120° such that closure cover 142 has a substantially rectangular configuration. More specifically, in at least some embodiments, angle 148 is between approximately 75° and 105°. Alternatively, in other embodiments, lateral, leading, and/or trailing edges 144, 150, and 152, respectively, may have any configuration that enables closure cover 142 to function as described herein.

In some embodiments, each cover 106 for each transition bucket 130 is a transition cover 154 that includes a first lateral edge 156 formed in the first configuration and a second lateral edge 158 formed in the second configuration. Accordingly, in at least some embodiments, each transition bucket 130 is positionable between a respective bucket 126 and closure bucket 128 in only one orientation. In some embodiments, a first transition bucket 160 has a leading edge 162 that is shorter than a trailing edge 164, and a second transition bucket 166 has a leading edge 168 that is longer than a trailing edge 170. In some embodiments, transition buckets 160 and 166 are coupleable to each other along their respective second lateral edges 158.

During assembly, each dovetail 96 for each bucket 126 is inserted into dovetail groove 98 to couple buckets 126 to rotor disk 76. Each dovetail 96 for each transition bucket 130 is inserted into dovetail groove to couple transition buckets 130 to rotor disk 76. More specifically, in at least some embodiments, first transition bucket 160 is slid in a first circumferential direction to couple first transition bucket 160 to a first bucket 126, and second transition bucket 166 is slid in a second, opposite circumferential direction to couple second transition bucket 166 to a second bucket 126 such that a gap (not shown) is defined between transition buckets 160 and 166. Closure bucket 128 is positioned between transition buckets 160 and 166 to assemble a bucket assembly. Use of closure bucket 128 enables an easier assembly process when compared to a row of buckets which have all the same cover angle. Alternatively, in at least some embodiments, first transition bucket 160 may be directly coupled to second transition bucket 166 without the use of closure bucket 128.

The present disclosure relates generally to turbine engines and, more particularly, to a bucket assembly for use in a turbine engine. The embodiments described herein enable an application space of an integral covered (IC) bucket assembly including a plurality of IC buckets to be increased without removing a portion of at least one of the IC buckets during assembly of the IC bucket assembly. Accordingly, the embodiments described herein facilitate decreasing an assembly time of the IC bucket assembly and/or enhancing the performance of the IC bucket assembly Exemplary embodiments of a bucket assembly are described above in detail. The methods and systems are not limited to the embodiments described herein, but rather, components of systems and/or steps of the method may be utilized independently and separately from other components and/or steps described herein. Each method step and each component may also be used in combination with other method steps and/or components. Although specific features of various embodiments may be shown in some drawings and not in others, this is for convenience only. Any feature of a drawing may be referenced and/or claimed in combination with any feature of any other drawing.

This written description uses various embodiments to disclose the subject matter, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of assembling a bucket assembly, the method comprising:

inserting a dovetail of each of a first bucket, a first transition bucket, a second transition bucket, and a second bucket into a dovetail groove defined circumferentially within a rotor disk, the first and second buckets each including a bucket cover that includes a pair of lateral edges that are each formed in a first configuration;

coupling the first transition bucket against the first bucket by sliding the first transition bucket in a first circumferential direction along the dovetail groove, the first transition bucket including a first transition cover that includes a first lateral edge that is formed in the first configuration and a second lateral edge that is formed in a second configuration; and coupling the second transition bucket against the second bucket by sliding the second transition bucket in a second circumferential direction along the dovetail groove opposite the first circumferential direction, the second transition bucket including a second transition cover that includes a first lateral edge that is formed in the first configuration and a second lateral edge that is formed in the second configuration.

2. A method in accordance with claim 1 further comprising coupling a closure bucket to the rotor disk and between the first transition bucket and the second transition bucket, the closure bucket including a closure cover that includes a pair of lateral edges that are each formed in the second configuration.

3. A method in accordance with claim 2, wherein coupling a closure bucket further comprises providing each closure cover lateral edge to be substantially straight such that the second configuration is a substantially straight configuration.

4. A method in accordance with claim 2 further comprising providing the first bucket, the second bucket, the closure bucket, the first transition bucket, and the second transition bucket to include a body extending radially inwardly from a respective cover, wherein the bodies are substantially similar to each other.

5. A method in accordance with claim 2 further comprising providing the first bucket, the second bucket, the closure bucket, the first transition bucket, and the second transition bucket to include an airfoil extending radially inwardly from a respective cover, and a dovetail extending radially inwardly from a respective airfoil, wherein an airfoil height is shorter than a dovetail height.

6. A method in accordance with claim 1, wherein coupling a first bucket and a second bucket further comprises providing each bucket cover lateral edge to include a first segment and a second segment that extends from the first segment at an angle such that the first configuration is an angled configuration.

7. A method in accordance with claim 1, wherein coupling a first transition bucket further comprises providing the first transition bucket to include a leading edge that is shorter than a trailing edge of the first transition bucket, and wherein coupling a second transition bucket further comprises providing the second transition bucket to include a leading edge that is longer than a trailing edge of the second transition bucket.

8. A bucket assembly for use with a turbine engine, said bucket assembly comprising:

a plurality of first buckets, each first bucket comprising a dovetail configured for insertion into a dovetail groove defined circumferentially within a rotor disk of the turbine engine, and a bucket cover including a pair of lateral edges each formed in a first configuration; and a pair of transition buckets, each transition bucket comprising a dovetail configured for insertion into the dovetail groove and a transition cover including a first lateral edge formed in the first configuration and a second lateral edge formed in a second configuration, wherein a first of the transition buckets is slidable along the dovetail groove in a first circumferential direction to couple against one of the first buckets and a second of the transition buckets is slidable in a second circumferential direction along the dovetail groove opposite the first circumferential direction to couple against another of the first buckets.

9. A bucket assembly in accordance with claim 8 further comprising a closure bucket comprising a closure cover including a pair of lateral edges each formed in the second configuration.

10. A bucket assembly in accordance with claim 9, wherein each closure cover lateral edge is substantially straight such that the second configuration is a substantially straight configuration.

11. A bucket assembly in accordance with claim 9, wherein each first bucket, the closure bucket, and each transition bucket comprises a body extending radially inwardly from a respective cover, wherein the bodies are substantially similar to each other.

12. A bucket assembly in accordance with claim 8, wherein each bucket cover lateral edge comprises a first segment and a second segment that extends from the first segment at an angle such that the first configuration is an angled configuration.

13. A bucket assembly in accordance with claim 8, wherein a first transition bucket has a leading edge that is shorter than a trailing edge of the first transition bucket, and a second transition bucket has a leading edge that is longer than a trailing edge of the second transition bucket.

14. A turbine engine comprising:

a rotor disk comprising a dovetail groove defined circumferentially therein; and a bucket assembly coupled to the rotor disk, the bucket assembly comprising a plurality of first buckets and a pair of transition buckets, wherein each first bucket comprises a dovetail configured for insertion into the dovetail groove and a bucket cover including a pair of lateral edges each formed in a first configuration, and each transition bucket of the pair of transition buckets comprises a dovetail configured for insertion into the dovetail groove and a transition cover including a first lateral edge formed in the first configuration and a second lateral edge formed in a second configuration, wherein a first of the transition buckets is slidable in a first circumferential direction along the dovetail groove to couple against one of the first buckets and a second of the transition buckets is slidable in a second circumferential direction along the dovetail groove opposite the first circumferential direction to couple against another of the first buckets.

15. A turbine engine in accordance with claim 14, wherein the bucket assembly further comprises a closure bucket comprising a closure cover including a pair of lateral edges each formed in the second configuration.

16. A bucket assembly in accordance with claim 15, wherein each closure cover lateral edge is substantially straight such that the second configuration is a substantially straight configuration.

17. A bucket assembly in accordance with claim 15, wherein each first bucket, the closure bucket, and each transition bucket comprises a body extending radially inwardly from a respective cover, wherein the bodies are substantially similar to each other.

18. A bucket assembly in accordance with claim 15, wherein each first bucket, the closure bucket, and each transition bucket comprises an airfoil extending radially inwardly from a respective cover, and a dovetail extending radially inwardly from a respective airfoil, wherein an airfoil height is shorter than a dovetail height.

19. A turbine engine in accordance with claim 14, wherein each bucket cover lateral edge comprises a first segment and a second segment that extends from the first segment at an angle such that the first configuration is an angled configuration.

20. A bucket assembly in accordance with claim 14, wherein a first transition bucket has a leading edge that is shorter than a trailing edge of the first transition bucket, and a second transition bucket has a leading edge that is longer than a trailing edge of the second transition bucket.

* * * * *